US006179724B1

(12) United States Patent
Yang et al.

(10) Patent No.: US 6,179,724 B1
(45) Date of Patent: Jan. 30, 2001

(54) DEVICE FOR CHANGING INCLINATION ANGLE OF GOLF BALL SWING TABLE

(76) Inventors: Hong Jun Yang, 101-1206, Woosung Apt., Moonheung-Dong, Buk-Ku; Sung-Ho Jung, 209, 1301, Rain Hyochin Apt., Bangrim-Dong, Nam-Ku, both of (KR)

( * ) Notice: Under 35 U.S.C. 154(b), the term of this patent shall be extended for 0 days.

(21) Appl. No.: 09/375,360

(22) Filed: Aug. 17, 1999

(30) Foreign Application Priority Data

Feb. 25, 1999 (KR) ..... 99-6341
May 14, 1999 (KR) ..... 99-8234

(51) Int. Cl.[7] ..... A63B 69/36
(52) U.S. Cl. ..... 473/279
(58) Field of Search ..... 473/278, 279, 473/161

(56) References Cited

U.S. PATENT DOCUMENTS 5,333,876 * 8/1994 Goto ..... 473/279
5,431,406 * 7/1995 Ishii ..... 473/279
5,460,379 * 10/1995 Cleland ..... 473/279
5,944,615 * 8/1999 Lee ..... 473/279

* cited by examiner

*Primary Examiner*—Steven Wong
(74) *Attorney, Agent, or Firm*—Jacobson, Price, Holman & Stern, PLLC

(57) ABSTRACT

Disclosed is a device for changing an inclination angle of a golf ball swing table. The device comprises a frame having a base plate, a support skeleton which is installed on a center portion of the base plate and has a wire passing part, and a transverse shaft which is formed with a first groove and is mounted on the support skeleton; a golf ball swing table having a longitudinal shaft which is mounted on a center portion of a lower surface of the golf ball swing table, the longitudinal shaft being formed at a middle portion thereof with a second groove such that the transverse shaft and the longitudinal shaft are engaged with each other at the first and second grooves; first and second operating sections having respectively first and second wires which are supported by and extend along the base plate of the frame in diagonal directions and fastened at both ends thereof to the golf ball swing table, first and second rollers and first and second tighteners which grasp portions of the first and second wires adjacent to both ends thereof, and first and second winding parts which wind and unwind the first and second wires therearound and therefrom; and an angle adjusting section connected through a control part to the first and second operating sections and mounted on one side front portion of the golf ball swing table.

10 Claims, 10 Drawing Sheets

DEVICE FOR CHANGING INCLINATION ANGLE OF GOLF BALL SWING TABLE

BACKGROUND OF THE INVENTION

1. Field of the Invention

The present invention relates to a device for changing an inclination angle of a golf ball swing table, and more particularly, the present invention relates to a device for changing an inclination angle of a golf ball swing table, which allows a golfer to stably perform swing practice even in a narrow indoor space in the same ground conditions as in the outdoor field and provides at one side front portion of the golf ball swing table an angle adjusting section capable of being manipulated by using a golf club or by a golfer's foot thereby to enable the golfer to easily change an inclination angle of the golf ball swing table while being on the golf ball swing table.

2. Description of the Related Art

Recently, in playing golf, which gradually occupies its position as a leisure sport, a wide space must be utilized, and a great deal of practice is needed to satisfactorily play golf at various outdoor conditions. Such practice is frequently performed in an indoor golf practice range.

In the swing practice which is performed at an indoor golf practice range, a golfer drives a golf ball on a golf ball swing table to develop a correct swing posture.

However, in actually playing golf in an outdoor field, because the ground is inclined in leftward, rightward, forward or backward directions depending upon field conditions, a difference is generated when compared to the swing practice which is performed in an indoor practice range, and thereby it is difficult to smoothly play golf at the outdoor field, due to inadequate realistic practice.

To cope with this problem, a device for dimensionlessly changing an inclination angle of a golf ball swing table is disclosed in the art, as described in the Korean Patent Publication No. 97-4365, a construction of which will be described hereinafter with reference to FIG. 11.

FIG. 11 is a schematic constructional view illustrating a device for dimensionlessly changing an inclination angle of a golf ball swing table of the conventional art. The device of the conventional art includes a power transmitting section, a rotating section, an inclination angle changing section and a braking support section.

In the power transmitting section, a driving motor 102 is installed to a one side lower portion of a body part 101 of the device 100. The driving motor 102 is installed such that it is connected to a reduction gear by a belt. A reduced rotation part 103 is installed beside the reduction gear. The power transmitting section rotates a driving shaft 104 and a disk 105 which are vertically uprighted on the reduced rotation part 103.

In the rotating section, the disk 105 is installed to a lower surface of the driving shaft 104 which is rotatably driven while being vertically uprighted on the reduced rotation part 103. The driving shaft 104 which is disposed on the disk 105, is eccentrically installed. One end of the guide bar 106 is horizontally coupled to a middle portion of the driving shaft 104, and one end of a coupling piece 107 is horizontally coupled to the other end of the guide bar 106 by a coupling bolt. A first wheel 109 to which a chain 108 is wound is rotatably installed to an upper end of the driving shaft 104.

In the inclination angle changing section, as described above, one end of the guide bar 106 is horizontally coupled to the middle portion of the driving shaft 104, and one end of the coupling piece 107 is horizontally coupled to the other end of the guide bar 106 by the coupling bolt. In addition, a pot-shaped coupling part 201 which is provided at a lower part of a vertically uprighted rotating shaft 200, is connected with the other end of the coupling piece 107. Above the pot-shaped coupling part 201, a second wheel 202 is rotatably installed to the rotating shaft 200 such that the second wheel 202 is connected to the first wheel 109 via the chain 108. A foot plate support part 203 is installed at an upper part of the rotating shaft 200 to support a circular foot plate 204 and to change an inclination angle of the foot plate 204.

In the braking support section, a jar-shaped rotating member 205 is integrally fitted around a circumferential outer surface of the foot plate support part 203 which supports the foot plate 204. An engaging member 206 is detachably installed around a circumferential outer surface of the jar-shaped rotating member 205. A rotating member engaging part 207 into which the engaging member 206 is fitted, is installed on an upper end of the body part 101, to securely support the foot plate 204 which is inclined at a certain angle by the inclination angle changing section.

In operations of the device for dimensionlessly changing an inclination angle of a golf ball swing table of the conventional art, constructed as mentioned above, as the driving motor 102 of the power transmitting section is driven, the driving shaft 104 of the reduced rotation section is rotated by power transmitting means such as the reduction gear which is interlocked with the belt, or the like.

Accordingly, as the disk 105 which is eccentrically installed on the driving shaft 104 which is rotated by the power transmitting section, is eccentrically rotated, the guide bar 106 which is coupled to the coupling piece 107 is moved in a horizontal direction.

On the other hand, due to the fact that the first wheel 109 of the driving shaft 104 is connected by the chain 108 to the second, wheel 202 of the rotating shaft 200 which is connected to the guide bar 106 via the coupling piece 107, rotating force of the driving shaft 104 is transmitted to the rotating shaft 200 which is disposed below the foot plate 204 to be integrally and slowly rotated.

At this time, since the guide bar 106 which is coupled to the lower part of the rotating shaft 200 through the coupling piece 107, is pulled leftward or rightward by the eccentric rotation of the driving shaft 104 which is disposed on the disk 105, the rotating shaft 200 is slightly inclined from a vertically uprighted position by an angle, thereby to be changed in its inclination angle.

Accordingly, by the change in angle of the rotating shaft 200, the foot plate support part 203 and the foot plate 204 which are arranged on the rotating shaft 200 are changed in their angle, and one sides thereof are maintained in a downwardly inclined state.

On the other hand, in order to securely maintain the foot plate 204 which is inclined downward as described above, as the jar-shaped rotating member 205 which is fitted around the foot plate support part 203 is smoothly rotated in the engaging member 206 of the rotating member engaging part 207, the jar-shaped rotating member 205 is secured by an electronic clutch which is constructed by the fact that a coil is wound around the engaging member 206, the electronic clutch serving as braking means for the jar-shaped rotating member 205 which is integrally formed with the foot plate support part 203.

The foot plate 204 which is completed in its change of an inclination angle, is secured by turning off a driving switch (not shown), and in this state, it is possible to stably perform swing practice even in a narrow indoor space in the same ground conditions as in the outdoor field.

However, the device for dimensionlessly changing an inclination angle of a golf ball swing table of the conventional art, constructed as mentioned above, suffers from defects in that since an inclination angle of the circular foot plate 204 is adjusted by the inclination angle adjusting section which is installed in a longitudinal direction, when the foot plate 204 is not vertically positioned, supporting force of the entire device is remarkably decreased, thereby to be deteriorated in its stability.

Moreover, since components constituting the device have complicated structures, failure occurs frequently.

In addition, in the case that it is necessary to change an inclination angle of the foot plate, because the separate control part which is installed outside the foot plate must be actuated, the swing practice cannot but be temporarily stopped to actuate the control part, whereby the effects of practice and exercise are lessened.

Additionally, because a golfer should move back onto the foot plate after the inclination angle of the foot plate is changed, accident may be caused.

SUMMARY OF THE INVENTION

Accordingly, the present invention has been made in an effort to solve the problems occurring in the related art, and an object of the present invention is to provide a device for changing an inclination angle of a golf ball swing table, which securely supports the golf ball swing table at four points by wires when the golf ball swing table is inclined, thereby to prevent the golf ball swing table from being changed in its position.

Another object of the present invention is to provide a device for changing an inclination angle of a golf ball swing table which allows an inclination angle of the golf ball swing table to be simply changed on four points on the golf ball swing table, thereby to minimize failure due to complicated operations.

Another object of the present invention is to provide a device for changing an inclination angle of a golf ball swing table which provides an angle adjusting section capable of being manipulated by using a golf club or by a golfer's foot, to enable a golfer to easily change an inclination angle of the golf ball swing table while being on the golf ball swing table, thereby to increase convenience.

Another object of the present invention is to provide a device for changing an inclination angle of a golf ball swing table which can prevent accident from occurring due to movement of a golfer while practicing.

In order to achieve the above object, according to one aspect of the present invention, there is provided a device for changing an inclination angle of a golf ball swing table, comprising: a frame having a base plate, a support skeleton which is installed on a center portion of the base plate and has a wire passing part, and a transverse shaft which is formed with a first groove and is mounted on the support skeleton; a golf ball swing table having a longitudinal shaft which is mounted on a center portion of a lower surface of the golf ball swing table, the longitudinal shaft being formed at a middle portion thereof with a second groove such that the transverse shaft of the frame and the longitudinal shaft of the golf ball swing table are engaged with each other at the first and second grooves; first and second operating sections having respectively first and second wires which are supported by and extend along the base plate of the frame in diagonal directions and fastened at both ends thereof to the golf ball swing table, first and second rollers and first and second tighteners which grasp portions of the first and second wires adjacent to both ends thereof, and first and second winding parts which wind and unwind the first and second wires therearound and therefrom; and an angle adjusting section connected through a control part to the first and second operating sections and mounted on one side front portion of the golf ball swing table.

BRIEF DESCRIPTION OF THE DRAWINGS

The above objects, and other features and advantages of the present invention will become more apparent after a reading of the following detailed description when taken in conjunction with the drawings, in which:

FIGS. 7*a* and 7*b* are views illustrating a winding part according to the present invention, wherein FIG. 7*a* is a cross-sectional view taken along the line IV—IV of FIG. 4 and FIG. 7*b* is a cross-sectional view taken along the line V—V of FIG. 7*a;*

DETAILED DESCRIPTION OF PREFERRED EMBODIMENTS

Figure 1:
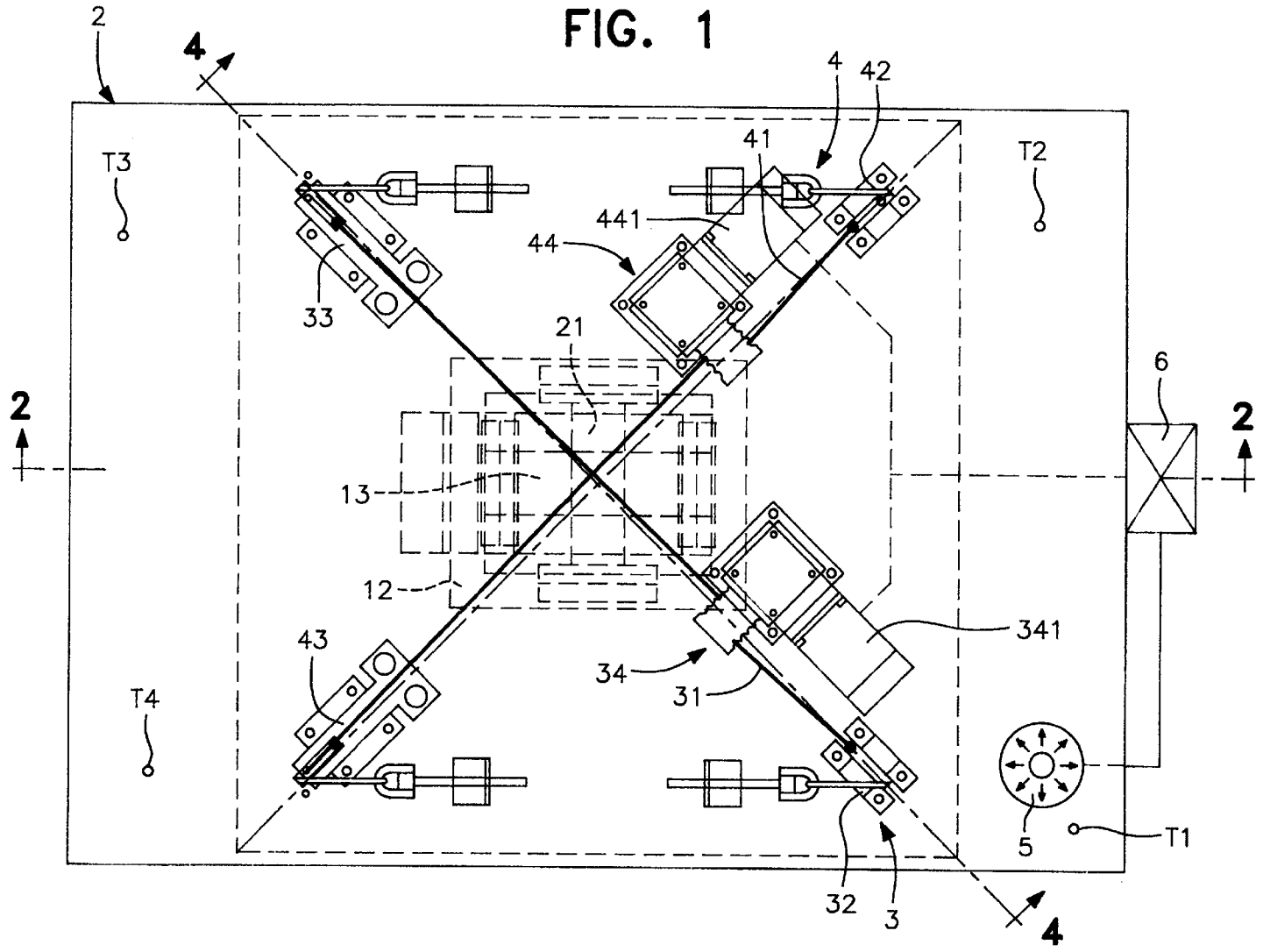
FIG. 1 is a schematic plan view illustrating a device for changing an inclination angle of a golf ball swing table in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
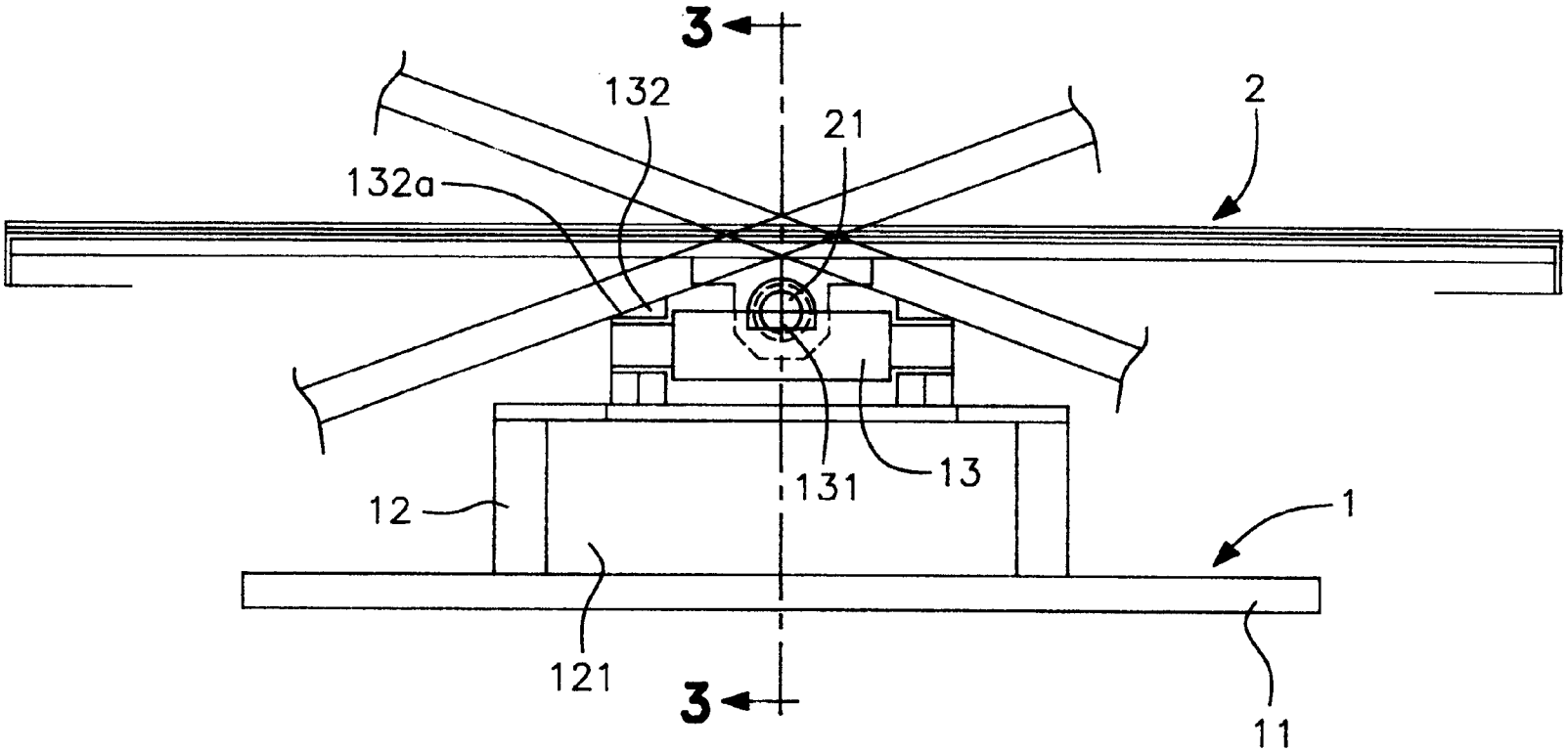
FIG. 2 is a schematic cross-sectional view taken along the line I—I of FIG. 1.

A construction of the device in accordance with an embodiment of the present invention will be described first with reference to FIGS. 1 and 2 wherein FIG. 1 is a schematic plan view illustrating a device for changing an inclination angle of a golf ball swing table in accordance with an embodiment of the present invention; and FIG. 2 is a schematic cross-sectional view taken along the line I—I of FIG. 1.

The device according to the present invention includes a frame 1, a golf ball swing table 2, first and second operating sections 3 and 4, and an angle adjusting section 5. A support skeleton 12 is installed on a center portion of a base plate 11. The support skeleton 12 defines a wire passing part 121. A transverse shaft 13 is mounted on the support skeleton 12 and is formed with a first groove 131 for allowing a longitudinal shaft 21 to be placed at a center portion of the transverse shaft 13. The longitudinal shaft 21 is mounted on a center portion of a lower surface of the golf ball swing table 2. The longitudinal shaft 21 is formed at a middle portion thereof with a second groove 211 such that the transverse shaft 13 of the frame 1 and the longitudinal shaft 21 of the golf ball swing table 2 are engaged with each other at the first and second grooves 131 and 211. The first and second operating sections 3 and 4 respectively have first and second wires 31 and 41 which are supported by and extend along the base plate 11 of the frame 1 in diagonal directions and fastened at both ends thereof to the golf ball swing table 2, first and second rollers 32 and 42 and first and second tighteners 33 and 43 which grasp portions of the first and second wires 31 and 41 adjacent to both ends thereof, and first and second winding parts 34 and 44 which wind and unwind the first and second wires 31 and 41 therearound and therefrom. The angle adjusting section 5 is connected through a control part 6 to the first and second operating sections 3 and 4 and is mounted on one side front portion of the golf ball swing table 2.

The construction of the device in accordance with the embodiment of the present invention will be described hereinafter in further detail.

Figure 3:
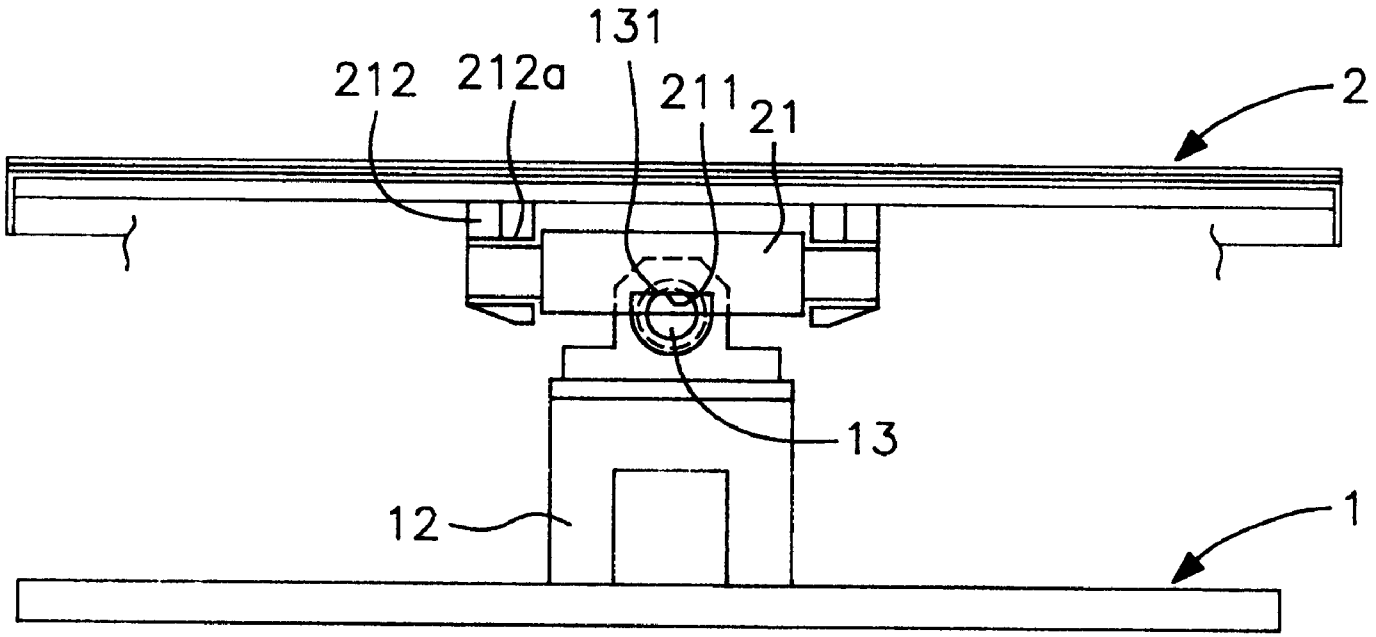
FIG. 3 is a schematic cross-sectional view taken along the line II—II of FIG. 2.

The transverse shaft 13 which is mounted on the support skeleton 12 of the frame 1 and the longitudinal shaft 21 which is mounted on the golf ball swing table 2 are, as shown in FIGS. 2 and 3, crossed with each other at the first and second grooves 131 and 211 which are formed at middle portions thereof, respectively. The transverse shaft 13 and the longitudinal shaft 21 can be independently or separately rotated, thereby to cooperatively define a universal joint.

In other words, both ends of the transverse shaft 13 are supported by a pair of first bearings 132*a* which are mounted to a pair of first brackets 132, respectively, which are in turn secured to the support skeleton 12, and both ends of the longitudinal shaft 21 are supported by a pair of second bearings 212*a* which are mounted to a pair of second brackets 212, respectively, which are in turn secured to the golf ball swing table 2, whereby the transverse shaft 13 and the longitudinal shaft 21 can be independently or separately rotated.

Figure 4:
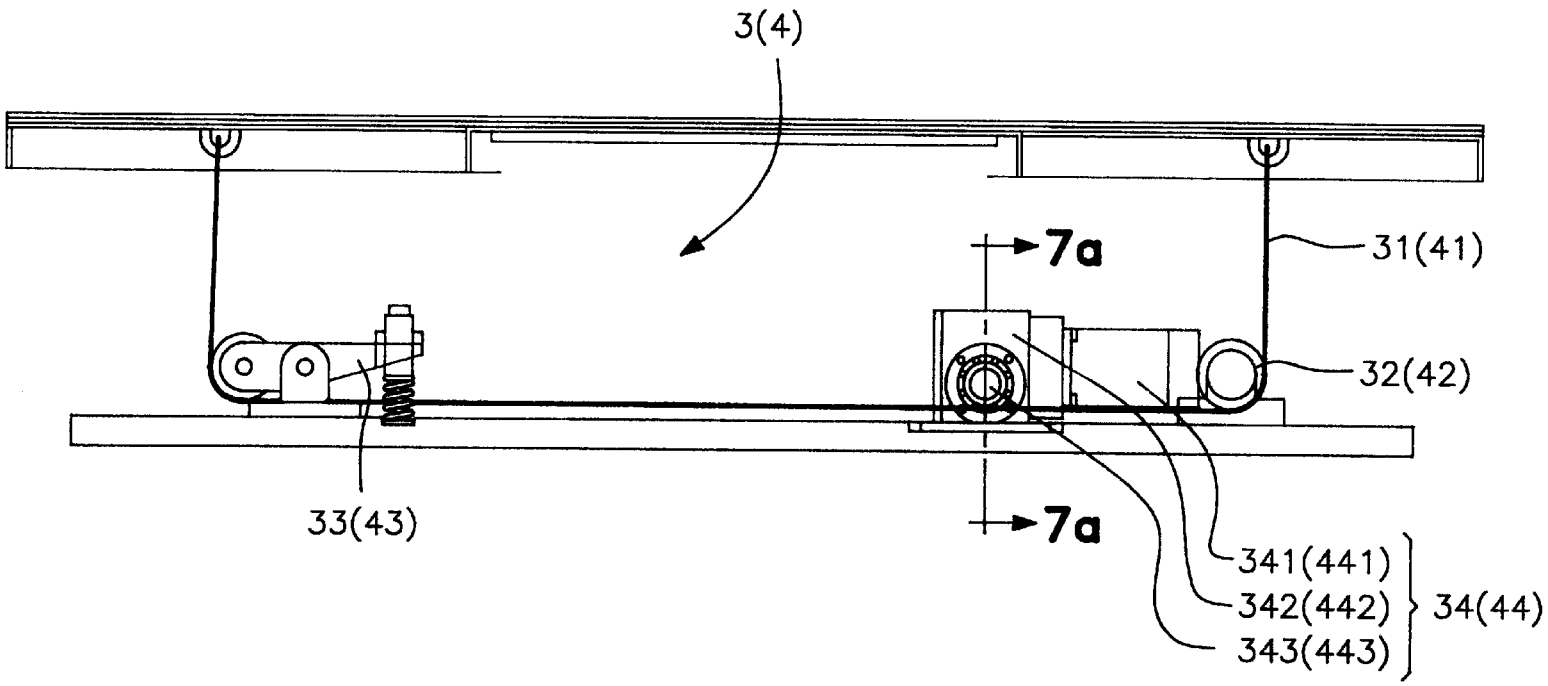
FIG. 4 is a schematic cross-sectional view taken along the line III—III of FIG. 1.

As described above and as shown in FIG. 4, the first and second operating sections 3 and 4 comprise the first and second wires 31 and 41, the first and second rollers 32 and 42, the first and second tighteners 33 and 43, and the first and second winding parts 34 and 44, respectively.

Figure 5:
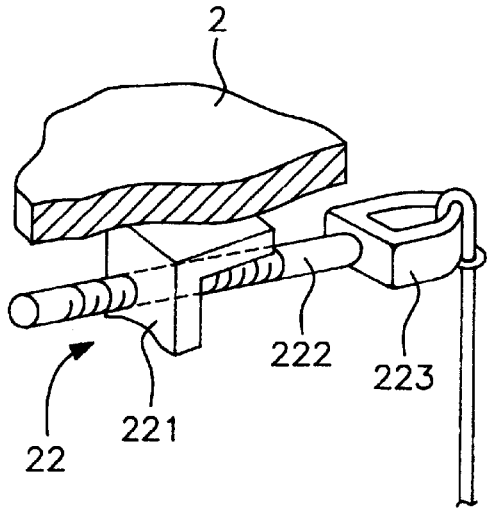
FIG. 5 is a perspective view illustrating a connection part according to the present invention.

Accordingly, both ends of the first and second wires 31 and 41 of the first and second operating sections 3 and 4 are fastened to the golf ball swing table 2 through four connection parts 22, respectively, which are disposed at four points on the lower surface of the golf ball swing table 2. Each connection part 22 comprises, as shown in FIG. 5, a third bracket 221 which is secured to the golf ball swing table 2 and a tension adjusting screw 222 which is locked to the third bracket 221 to be moved forward and backward. The tension adjusting screw 222 has at one end thereof a fastening ring 223 to which each end of the first and second wires 31 and 41 is fastened.

The first and second rollers 32 and 42 are secured to one side front and rear portions of the base plate 11 and serve to guide one ends of the first and second wires 31 and 41 therearound, respectively.

Figure 6:
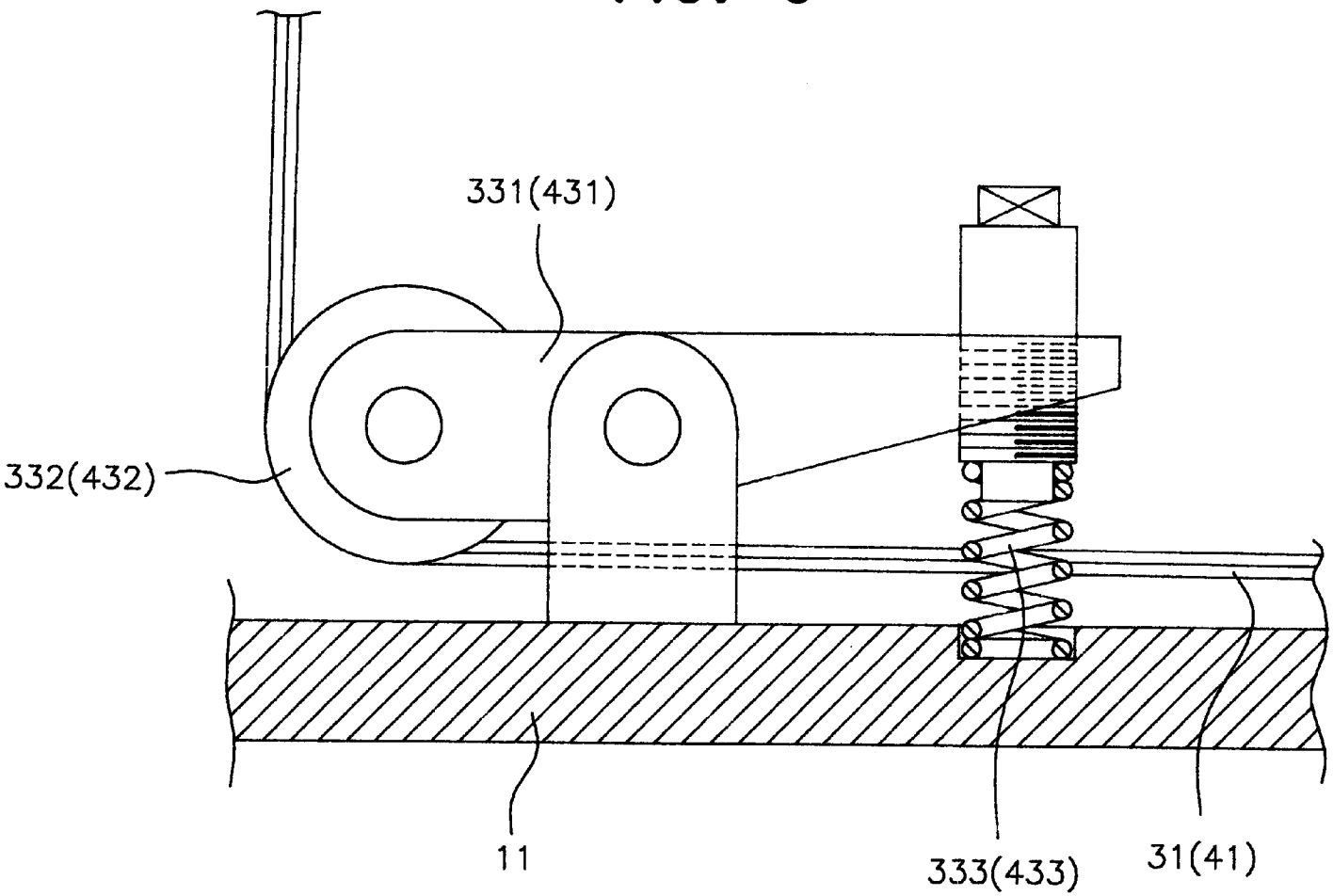
FIG. 6 is a schematic view illustrating a tightener according to the present invention.

In addition, the first and second tighteners 33 and 43 are, as shown in FIG. 6, installed to the other side front and rear portions of the base plate 11, thereby to grasp the other ends of the first and second wires 31 and 41, respectively. The first and second tighteners 33 and 43 comprise partition plates 331 and 431 middle portions of which are secured to the base plate 11 via hinges, third rollers 332 and 432 which are rotatably secured to one ends of the partition plates 331 and 431, and compression coil springs 333 and 433 which are provided to the other ends of the partition plates 331 and 431 to be arranged between the base plate 11 and the partition plates 331 and 431, respectively.

Figure 7A:
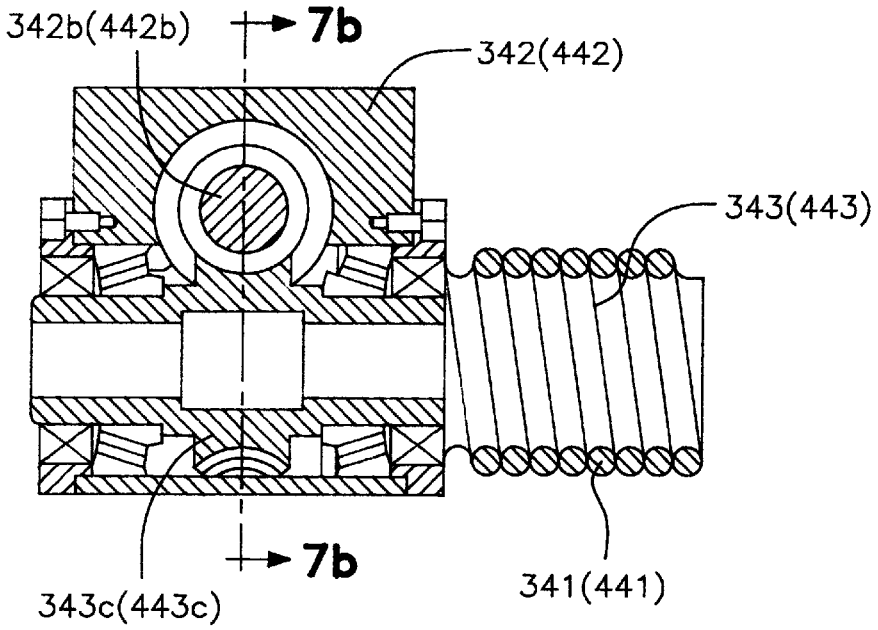
Figure 7B:
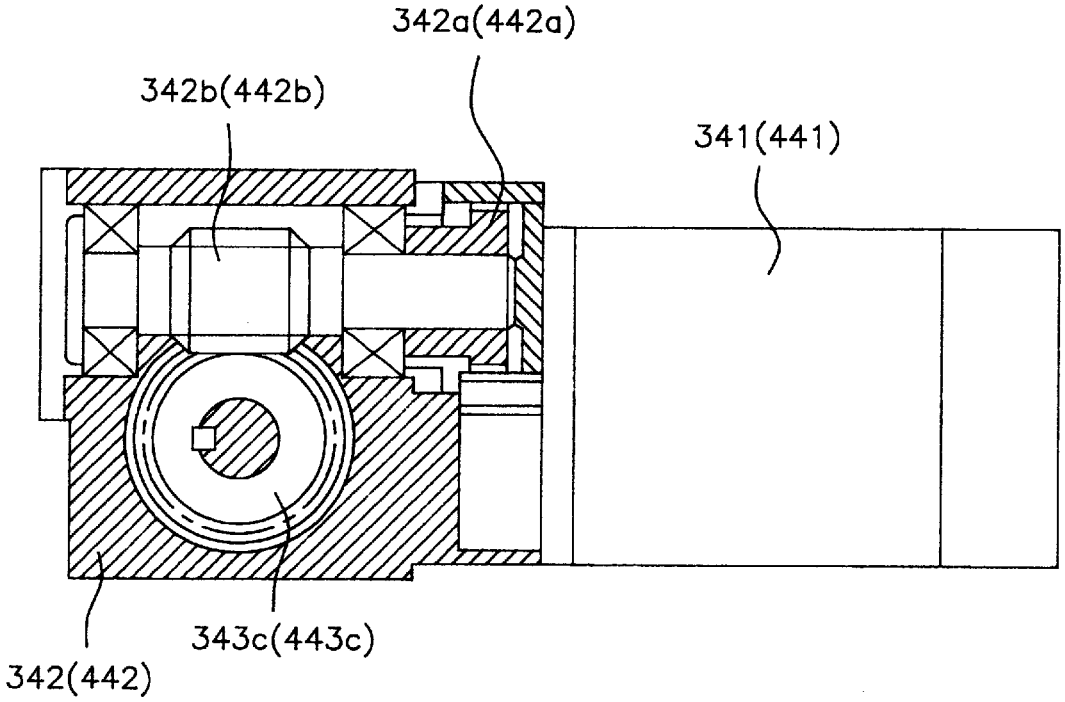

Moreover, the first and second winding parts 34 and 44 are, as shown in FIG. 7, arranged at substantially middle portions of the first and second wires 31 and 41, respectively, to wind therearound one portions of the first and second wires 31 and 41 and at the same time unwind therefrom the other portions of the first and second wires 31 and 41 and vice versa, thereby to incline the golf ball swing table 2 to a certain angle. The first and second winding parts 34 and 44 comprise driving motors 341 and 441, reduction gears 342 and 442 and winding rollers 343 and 443.

That is to say, rotating shafts of the driving motors 341 and 441 are connected to input shafts of the reduction gears 342 and 442, respectively, and the winding rollers 343 and 443 are connected to output shafts of the reduction gears 342 and 442.

In this connection, spur gears 342*a* and 442*a* are mounted to the input shafts of the reduction gears 342 and 442, respectively, to receive rotating force generated by the driving motors 341 and 441. Worm gears 342*b* and 442*b* are mounted to middle portions of the input shafts of the reduction gears 342 and 442, respectively, and worm wheels 343*c* and 443*c* which are meshed with the worm gears 342*b* and 442*b* are mounted to the output shafts of the reduction gears 342 and 442, respectively.

Figure 9:
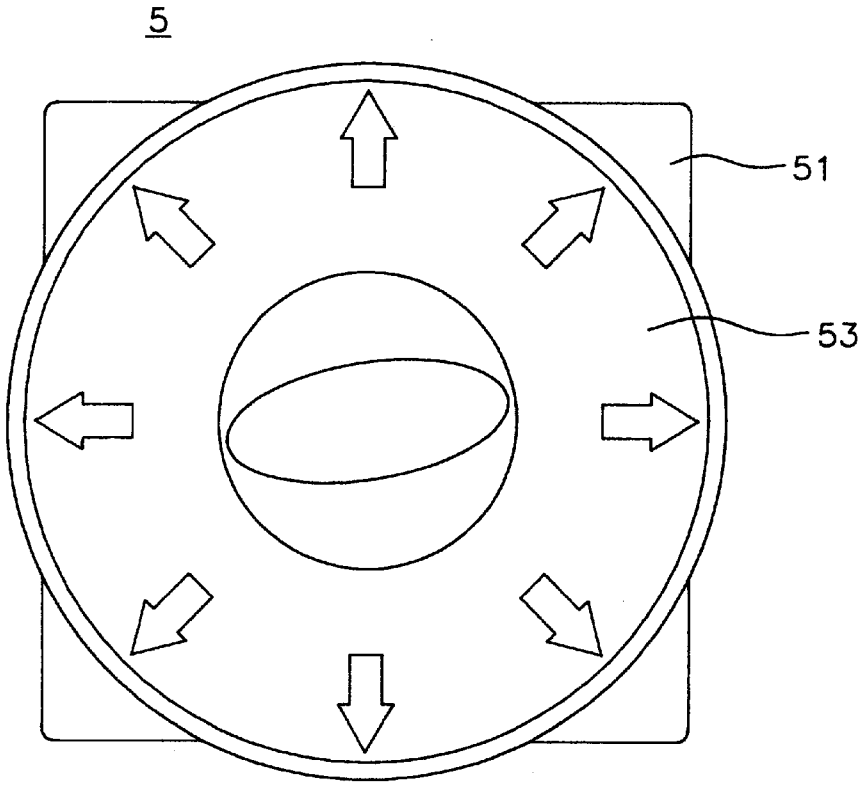
FIG. 9 is a plan view illustrating the angle adjusting section of the present invention.
Figure 8:
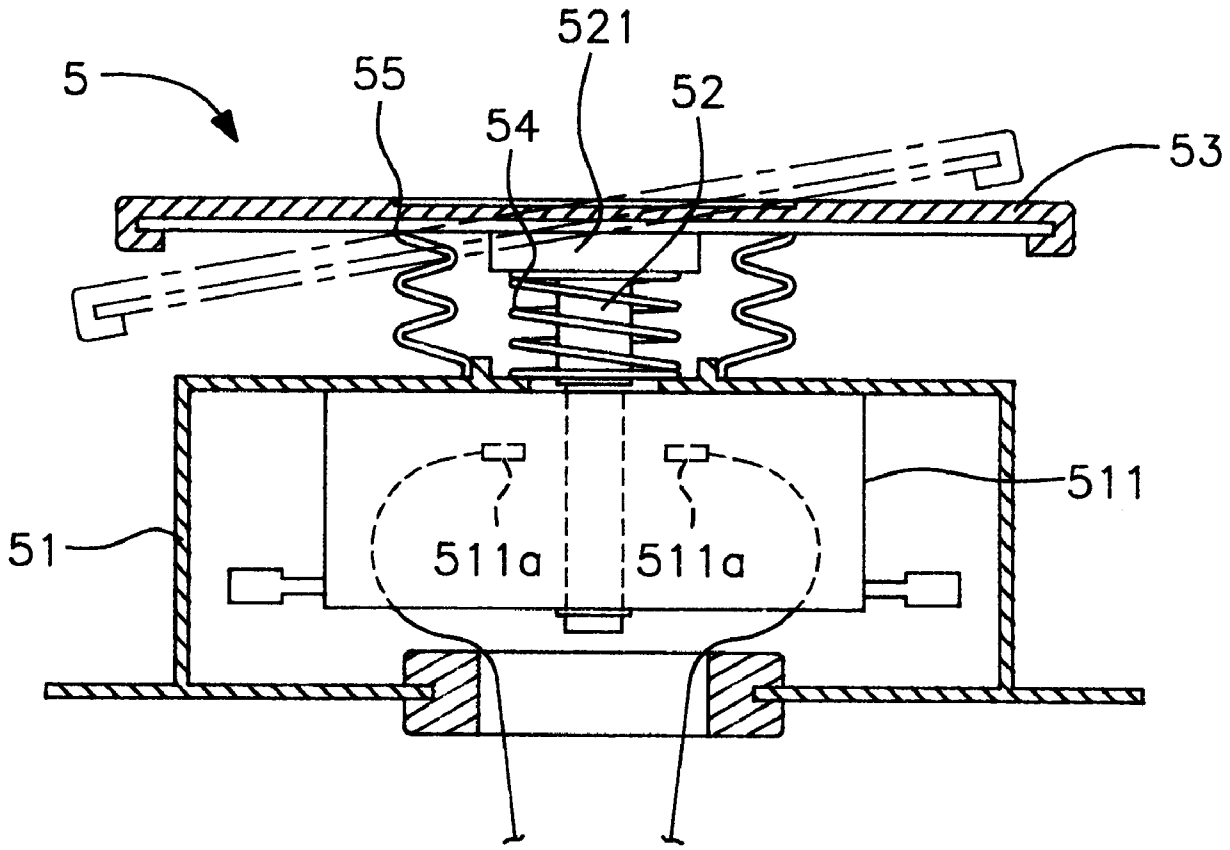
FIG. 8 is a constructional view illustrating an angle adjusting section of the present invention.

The angle adjusting section 5 is, as shown in FIGS. 8 and 9, connected to the control part 6 which is in turn connected to the driving motors 341 and 441 of the first and second winding parts 34 and 35 which constitute the first and second operating sections 3 and 4. The angle adjusting section 5 comprises a housing 51 in which a switch 511 connected to the control part 6 and having a plurality of terminals 511*a* mounted thereto in a multitude of directions is disposed; a moving shaft 52 which extends through a center portion of the switch 511 to be capable of being connected to the plurality of terminals 511*a* and has a holder 521 provided at an upper end thereof for mounting a manipulating plate 53; a spring 54 which is mounted between an upper surface of the housing 51 and a lower surface of the holder 521 for returning the manipulating plate 53 to its original horizontal position; and a bellows hose 55 surrounding the spring 54 and mounted between a lower surface of the manipulating plate 53 and the upper surface of the housing 51 for maintaining a sloping angle of the manipulating plate 53.

Figure 10:
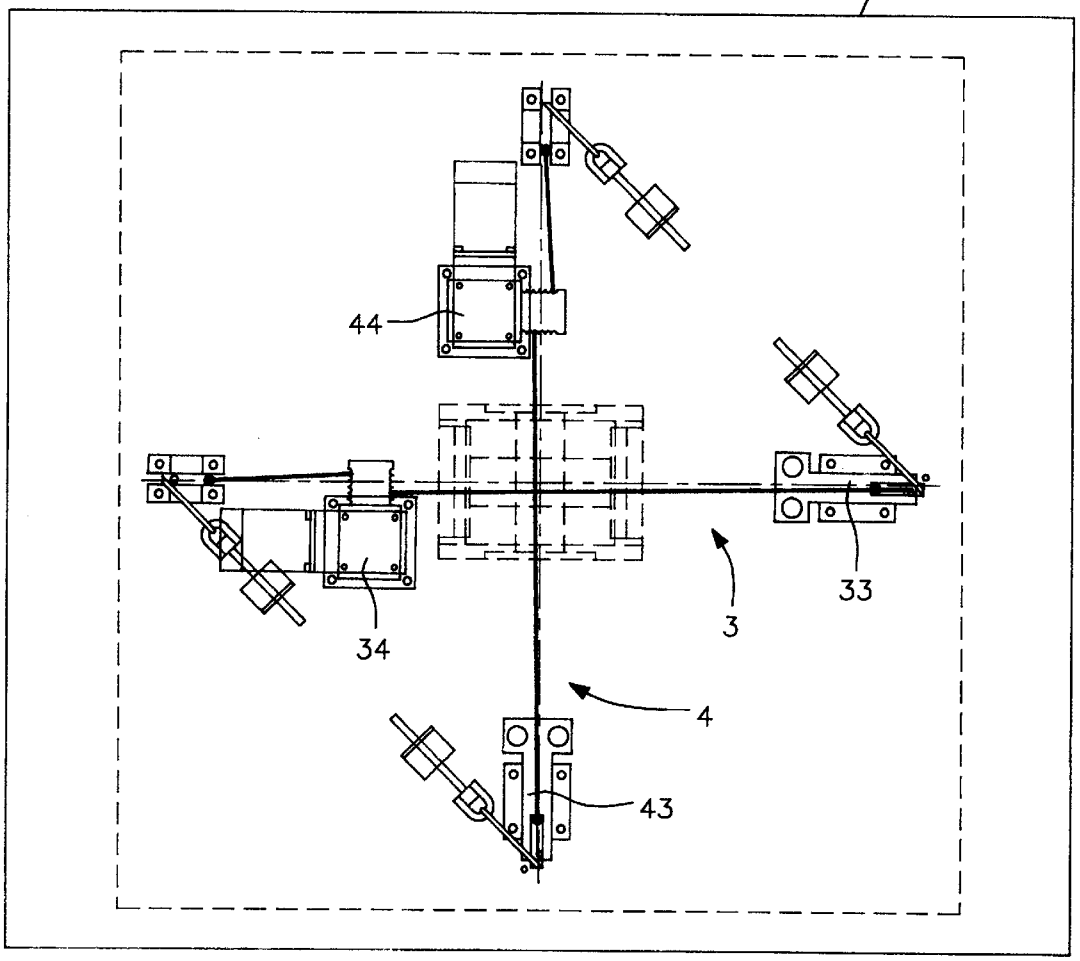
FIG. 10 is a schematic plan view illustrating a device for changing an inclination angle of a golf ball swing table in accordance with another embodiment of the present invention.
Figure 11:
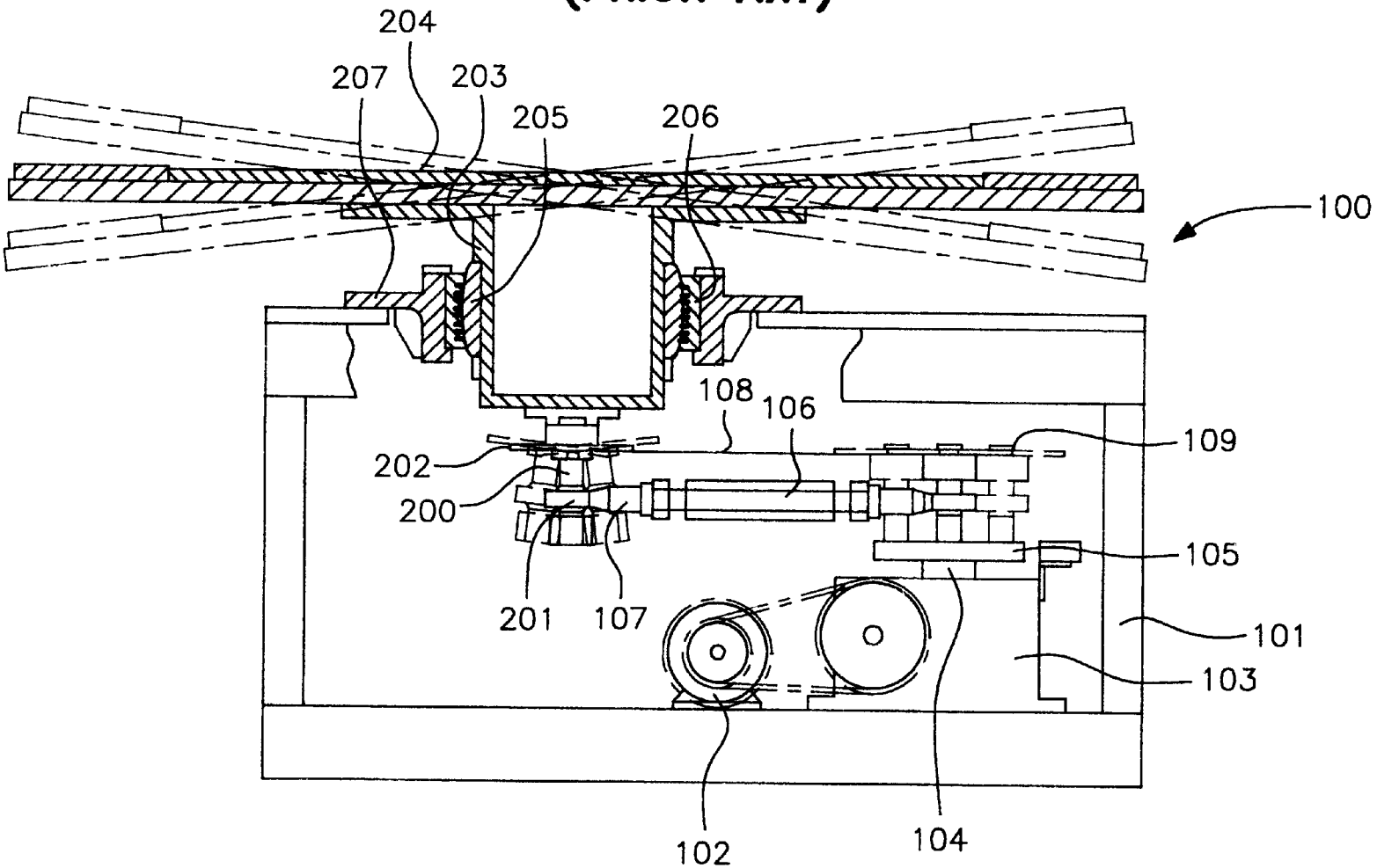
FIG. 11 (PRIOR ART)
FIG. 11 is a schematic constructional view illustrating a device for dimensionlessly changing an inclination angle of a golf ball swing table of the conventional art.

Referring now to FIG. 10, there is shown a schematic plan view illustrating a device for changing an inclination angle of a golf ball swing table in accordance with another embodiment of the present invention. In the present embodiment of the present invention, detailed constructions of first and second operating sections are the same as those of the first and second operating sections 3 and 4 of the first embodiment as aforementioned above, except that the first operating section 3 is transversely mounted on the base plate 11 in leftward and rightward directions and the second operating section 4 is longitudinally mounted on the base plate 11 in forward and backward directions, whereby enabling an inclination angle of the golf ball swing table to be adjusted in leftward, rightward, forward and backward directions.

Hereinafter, operations of the device for changing an inclination angle of a golf ball swing table according to the present invention, constructed as mentioned above, will be described in detail.

As shown in FIGS. 1 through 7, in the case that the golf ball swing table 2 is used in a state wherein it is horizontally maintained, conditions that the transverse shaft 13 installed to the frame 11 and the longitudinal shaft 21 installed to the golf ball swing table 2 are horizontally situated, must be satisfied.

Accordingly, by stopping the driving motors 341 and 441 of the first and second winding parts 34 and 44 around which the first and second wires 31 and 41 are wound, in the first and second wires 31 and 41 which have both ends fastened at four places to the golf ball swing table 2, lengths of the first and second wires 31 and 41 which project upward from the first and second rollers 32 and 42 are maintained as the same as those of the first and second wires 31 and 41 which project upward from the third rollers 332 and 432 of the first and second tighteners 33 and 43.

Thereafter, the golf ball swing table 2 can be inclinedly maintained in the way as described in below, and here, it is assumed that T1 denotes one side front portion, T2 one side rear portion, T3 the other side rear portion, and T4 the other side front portion.

First, in the case that it is necessary to raise the T1 portion and lower the T3 portion of the golf ball swing table 2, by actuating the driving motor 341 of the first operating section 3 through manipulation of the angle adjusting section 5 and thereby reversely rotating the winding roller 343, a T1 side portion of the first wire 31 is unwound from the winding roller 343, and a T3 side portion of the first wire 31 is wound around the winding roller 343. Therefore, the T1 portion of the golf ball swing table 2 is raised and at the same time, the T3 portion of the golf ball swing table 2 is lowered.

Also, in the case that it is necessary to raise the T2 portion and lower the T4 portion of the golf ball swing table 2, by actuating the driving motor 441 of the second operating section 4 through manipulation of the angle adjusting section 5 and thereby reversely rotating the winding roller 443, a T2 side portion of the second wire 41 is unwound from the winding roller 443, and a T4 side portion of the second wire 41 is wound around the winding roller 443. Therefore, the T2 portion of the golf ball swing table 2 is raised and at the same time, the T4 portion of the golf ball swing table 2 is lowered.

Further, in the case that it is necessary to raise the T3 portion and lower the T1 portion of the golf ball swing table 2, by actuating the driving motor 341 of the first operating section 3 through manipulation of the angle adjusting section 5 and thereby forwardly rotating the winding roller 343, the T1 side portion of the first wire 31 is wound around the winding roller 343, and the T3 side portion of the first wire 31 is unwound from the winding roller 343. Therefore, the T3 portion of the golf ball swing table 2 is raised and at the same time, the T1 portion of the golf ball swing table 2 is lowered.

Additionally, in the case that it is necessary to raise the T4 portion and lower the T2 portion of the golf ball swing table 2, by actuating the driving motor 441 of the second operating section 4 through manipulation of the angle adjusting section 5 and thereby forwardly rotating the winding roller 443, the T2 side portion of the second wire 41 is wound around the winding roller 443, and the T4 side portion of the second wire 41 is unwound from the winding roller 443. Therefore, the T4 portion of the golf ball swing table 2 is raised and at the same time, the T2 portion of the golf ball swing table 2 is lowered.

Hence, it is possible to change an inclination angle of the golf ball swing table 2 to a desired one by operating the first and second operating sections 3 and 4. In other words, by causing the T1 , T2, T3 and T4 portions of the golf ball swing table 2 to be moved as a whole, a desired inclination angle of the golf ball swing table 2 can be obtained.

Besides, by the fact that the first and second tighteners 33 and 43 which constitute the first and second operating sections 3 and 4, respectively, can adjust tension of the first and second wires 31 and 41, the first and second tighteners 33 and 43 prevent the first and second wires 31 and 41 from being released from their winding parts 34 and 44, respectively, and the golf ball swing table 2 from being fluctuated.

Hereinafter, with reference to FIGS. 1, 8 and 9, operations of the angle adjusting section 5 will be described in detail.

As a golfer gets on the golf ball swing table 2 and depresses, by using a golf club or by a golfer's foot an edge portion of the manipulation plate 53 which constitutes the angle adjusting section 5 thereby to vary a sloping angle of the manipulation plate 53, the moving shaft 52 which is interlocked with the manipulation plate 53 is connected to the terminal 511*a* which is disposed inside the switch 511.

And, at this time, one side portion of the bellows hose 55 which is mounted around the spring 54 is folded and the other side portion of the bellows hose 55 is unfolded, whereby the bellows hose 55 maintains the sloping angle of the manipulation plate 53 while overcoming returning force of the spring 54.

Thus, due to the fact that the control part 6 senses a connection between the terminals 511*a* and the moving shaft 52 and rotates in forward and reverse directions the driving motors 341 and 441 which constitute the first and second operating sections 3 and 4, respectively, an inclination angle of the golf ball swing table 2 is maintained as the same as a sloping angle of the manipulating plate 53.

On the contrary, if the golfer manipulates the manipulation plate 53 which constitutes the angle adjusting section 5, by using the golf club or by a golfer's foot, thereby to horizontally maintain the manipulating plate 53, the terminals 511*a* of the switch 511 which constitutes the angle adjusting section 5 are disconnected from the moving shaft 52. Then, the control part 6 senses this situation and rotates in forward and reverse directions the driving motors 341 and 441, and according to this, the golf ball swing table 2 is returned to its original position to be horizontally held.

As described above, according to the present invention, advantages are provided in that since a golf ball swing table is securely supported at four points by wires even when it is inclined, the golf ball swing table is prevented from being changed in its position, whereby it is possible to provide a stable device for changing an inclination angle of a golf ball swing table.

Further, while an inclination angle of the golf ball swing table can be simply changed on four points on the golf ball swing table, the number of components needed to construct the device is also decreased, thereby to minimize failure.

Moreover, due to the fact that a golfer can easily change an inclination angle of the golf ball swing table while being on the golf ball swing table, the effects of exercise and practice can be maximized.

In addition, since it is not necessary for the golfer to move around while on the inclined golf ball swing table during practicing, the golfer is less inclined to fall from the swing table.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A device for changing an inclination angle of a golf ball swing table, comprising:

a frame having a base plate, a support skeleton which is installed on a center portion of the base plate and has a wire passing part, and a transverse shaft which is formed with a first groove and is mounted on the support skeleton;

a golf ball swing table having a longitudinal shaft which is mounted on a center portion of a lower surface of the golf ball swing table, the longitudinal shaft being formed at a middle portion thereof with a second groove such that the transverse shaft of the frame and the longitudinal shaft of the golf ball swing table are engaged with each other at the first and second grooves;

first and second operating sections having respectively first and second wires which are supported by and extend along the base plate of the frame in diagonal directions and fastened at both ends thereof to the golf ball swing table, first and second rollers and first and second tighteners which grasp portions of the first and second wires adjacent to both ends thereof, and first and second winding parts which wind and unwind the first and second wires therearound and therefrom; and an angle adjusting section connected through a control part to the first and second operating sections and mounted on one side front portion of the golf ball swing table.

2. A device for changing an inclination angle of a golf ball swing table as claimed in claim 1, wherein the transverse shaft mounted on the support skeleton of the frame and the longitudinal shaft mounted on the golf ball swing table are crossed with each other at the first and second grooves; both ends of the transverse shaft are supported by a pair of first bearings which are mounted to a pair of first brackets, respectively, which are in turn secured to the support skeleton; and both ends of the longitudinal shaft are supported by a pair of second bearings which are mounted to a pair of second brackets, respectively, which are in turn secured to the golf ball swing table, whereby the transverse shaft and the longitudinal shaft can be independently rotated.

3. A device for changing an inclination angle of a golf ball swing table as claimed in claim 1, wherein both ends of the first and second wires of the first and second operating sections are fastened to the golf ball swing table through four connection parts, respectively; and each connection part comprises a third bracket and a tension adjusting screw which is locked to the third bracket and has a fastening ring to which each end of the first and second wires is fastened.

4. A device for changing an inclination angle of a golf ball swing table as claimed in claim 1, wherein the first and second rollers are secured to one side front and rear portions of the base plate, thereby to guide one ends of the first and second wires therearound, respectively.

5. A device for changing an inclination angle of a golf ball swing table as claimed in claim 1, wherein the first and second tighteners are installed to the other side front and rear portions of the base plate, thereby to grasp the other ends of the first and second wires, respectively; and each tightener comprises a partition plate, a middle portion of which is secured to the base plate via a hinge, a third roller which is rotatably secured to one end of the partition plate, and a compression coil spring which is provided to the other end of the partition plate to be arranged between the base plate and the partition plate.

6. A device for changing an inclination angle of a golf ball swing table as claimed in claim 1, wherein the first and second winding parts are arranged at substantially middle portions of the first and second wires, respectively, to wind therearound one portions of the first and second wires and at the same time unwind therefrom the other portions of the first and second wires and vice versa, thereby to incline the golf ball swing table; each winding part comprises a driving motor, a reduction gear and a winding roller; and a rotating shaft of the driving motor is connected to an input shaft of the reduction gear, and the winding roller is connected to an output shaft of the reduction gear.

7. A device for changing an inclination angle of a golf ball swing table as claimed in claim 6, wherein a spur gear is mounted to the input shaft of the reduction gear to receive rotating force generated by the driving motor; a worm gear is mounted to a middle portion of the input shaft of the reduction gear; and a worm wheel which is meshed with the worm gear is mounted to the output shaft of the reduction gear.

8. A device for changing an inclination angle of a golf ball swing table as claimed in claim 1, wherein driving motors of the first and second winding parts which constitute the first and second operating sections are connected to the control part; and in turn, the control part is connected to the angle adjusting section which is positioned at the one side front portion of the golf ball swing table to adjust a rotating direction of the driving motor.

9. A device for changing an inclination angle of a golf ball swing table as claimed in claim 1, wherein the angle adjusting section comprises a housing in which a switch connected to the control part and having a plurality of terminals mounted thereto in a multitude of directions is disposed; a moving shaft which extends through a center portion of the switch to be capable of being connected to the plurality of terminals and has a holder provided at an upper end thereof for mounting a manipulating plate; a spring which is mounted between an upper surface of the housing and a lower surface of the holder for returning the manipulating plate to its original horizontal position; and a bellows hose surrounding the spring and mounted between a lower surface of the manipulating plate and the upper surface of the housing for maintaining a sloping angle of the manipulating plate.

10. A device for changing an inclination angle of a golf ball swing table as claimed in claim 1, wherein the first operating section is transversely mounted on the base plate in leftward and rightward directions, and the second operating section is longitudinally mounted on the base plate in forward and backward directions.

* * * * *